US008552335B2

(12) United States Patent
Rego et al.

(10) Patent No.: US 8,552,335 B2
(45) Date of Patent: Oct. 8, 2013

(54) ATMOSPHERIC-PRESSURE PLASMA JET

(75) Inventors: Robby Jozef Martin Rego, Geel (BE); Danny Havermans, Beerse (BE); Jan Jozef Cools, Balen (BE)

(73) Assignee: Vlaamse Instelling Voor Technologisch Onderzoek N.V. (VITO), Mol (BE)

( * ) Notice: Subject to any disclaimer, the term of this patent is extended or adjusted under 35 U.S.C. 154(b) by 910 days.

(21) Appl. No.: 11/815,302

(22) PCT Filed: Feb. 6, 2006

(86) PCT No.: PCT/BE2006/000008

§ 371 (c)(1), (2), (4) Date: Apr. 7, 2008

(87) PCT Pub. No.: WO2006/081637

PCT Pub. Date: Aug. 10, 2006

(65) Prior Publication Data

US 2008/0308535 A1 Dec. 18, 2008

(30) Foreign Application Priority Data

Feb. 4, 2005 (EP) ..... 05447017

(51) Int. Cl.
*H05H 1/34* (2006.01)

(52) U.S. Cl.
USPC ..... 219/121.52

(58) Field of Classification Search
USPC ..... 219/121.36, 121.4, 121.41, 121.44, 219/121.48, 121.52, 121.59, 121.5, 121.51, 219/75; 118/723 E, 723 R; 315/111.21; 313/231.31, 231.41, 231.51; 216/67, 216/71

See application file for complete search history.

(56) References Cited

U.S. PATENT DOCUMENTS

| | | | | | |
|---|---|---|---|---|---|
| 4,594,496 | A | * | 6/1986 | Bebber et al. | 219/121.5 |
| 4,749,912 | A | * | 6/1988 | Hara et al. | 315/111.81 |
| 4,820,370 | A | * | 4/1989 | Ellenberger | 156/345.45 |
| 4,825,806 | A | * | 5/1989 | Tawada et al. | 118/719 |
| 5,105,123 | A | * | 4/1992 | Ballou | 315/111.21 |
| 5,225,651 | A | * | 7/1993 | De Gelis et al. | 219/121.43 |
| 5,756,959 | A | * | 5/1998 | Freeman et al. | 219/121.49 |
| 5,776,553 | A | * | 7/1998 | Jaffe et al. | 427/577 |

(Continued)

FOREIGN PATENT DOCUMENTS

| | | |
|---|---|---|
| DE | 197 35 362 A1 | 2/1998 |
| EP | 0 791 668 A2 | 8/1997 |

(Continued)

*Primary Examiner* — Yuwen Pan
*Assistant Examiner* — Mark Woodall
(74) *Attorney, Agent, or Firm* — Merchant & Gould P.C.

(57) ABSTRACT

A plasma jet apparatus for performing plasma processing of an article includes: an elongated central electrode (2,15), an elongated cylindrical outer electrode (1) or two outer electrodes (15,16) surrounding the central electrode and being coaxial with the central electrode, or two electrodes substantially parallel to the central electrode. an electrical insulator (3) or insulators (18,19) are disposed between the outer electrode(s) and the central electrode, wherein a discharge lumen having a distal end and a proximal end is defined between the central electrode and the electrical insulator(s). A supply opening (6) is disposed at the distal end of the discharge lumen for supplying a plasma producing gas to the discharge lumen, A power source (9) provides a voltage between the central electrode and said outer electrode. The electrical insulator has a radial or outward extension (40,20) at the proximal end beyond the outer surface of the outer electrode(s).

7 Claims, 5 Drawing Sheets

(56) References Cited

U.S. PATENT DOCUMENTS

| | | | | |
|---|---|---|---|---|
| 5,938,950 | A * | 8/1999 | Gay et al. | 219/121.54 |
| 6,262,523 | B1 * | 7/2001 | Selwyn et al. | 313/231.31 |
| 6,424,091 | B1 * | 7/2002 | Sawada et al. | 315/111.81 |
| 6,465,051 | B1 * | 10/2002 | Sahin et al. | 427/534 |
| 6,700,093 | B2 * | 3/2004 | Chiou et al. | 219/121.55 |
| 6,841,943 | B2 * | 1/2005 | Vahedi et al. | 315/111.71 |
| 2001/0023742 | A1 * | 9/2001 | Schmitt | 156/345 |
| 2001/0030024 | A1 * | 10/2001 | Sago et al. | 156/345 |
| 2002/0129902 | A1 * | 9/2002 | Babayan et al. | 156/345.45 |
| 2003/0070913 | A1 * | 4/2003 | Miller et al. | 204/192.1 |
| 2003/0141182 | A1 | 7/2003 | Kong et al. | |
| 2003/0180421 | A1 | 9/2003 | Ruan et al. | |

FOREIGN PATENT DOCUMENTS

| | | | |
|---|---|---|---|
| EP | 0 921 713 | A2 | 6/1999 |
| EP | 1 441 577 | | 7/2004 |
| JP | 06065739 | A * | 3/1994 |
| JP | 07-211656 | | 8/1995 |
| JP | 07211654 | A * | 8/1995 |
| JP | 10199697 | * | 7/1998 |
| JP | 2000311658 | A * | 11/2000 |
| WO | WO 98/35379 | | 8/1998 |
| WO | WO 99/20809 | | 4/1999 |

* cited by examiner

ATMOSPHERIC-PRESSURE PLASMA JET

FIELD OF THE INVENTION

The present invention is related to a plasma processing apparatus usable for plasma cleaning, surface modification and surface coating. More in particular, the present application is related to a novel plasma jet.

STATE OF THE ART

Atmospheric-pressure plasma jets are known in the art, e.g. as described by WO 98/35379 or WO 99/20809. These plasma jet devices comprise two coaxially placed electrodes defining a plasma discharge space between the outer diameter of the centrally placed electrode and the inner diameter of the outer electrode. A plasma jet can be generated at an open end of the device by introducing a flow of gas at a closed end of the device while a sufficient voltage is applied between the electrodes. Between said electrodes, a dielectric material can be placed to avoid arcing. The jet of plasma can be used to etch, clean or coat a surface. In the prior art devices, it is difficult to obtain a reasonably efficient plasma jet, due to several constraints of the currently known devices. For example, it is currently impossible to activate rubber sufficiently with a reasonably sized state-of-the-art classical plasma jet due to insufficient energy output. Most plasma jet devices therefore use nozzles to converge the plasma jet in order to obtain higher plasma densities. This however has the disadvantage that the treated spot is smaller and more devices, more time, or larger devices are necessary to treat a specific surface.

AIMS OF THE INVENTION

The present invention aims to provide a more efficient plasma jet device than known from the state of the art.

SUMMARY OF THE INVENTION

The present invention concerns an atmospheric-pressure plasma jet comprising a cylindrical 2-electrode device or a parallel 3-electrode device. The 2-electrode device can be a tubular device comprising a central cylindrical metal electrode and an outer cylindrical metal electrode, said cylindrical metal electrodes being coaxial and defining a plasma discharge lumen, said device having an open (proximal) end and a closed (distal) end, said plasma discharge lumen being open to the atmosphere at said open end and comprising a gas flow feed opening at said closed end, a dielectric material interposed between said central cylindrical metal electrode and said outer cylindrical metal electrode and is characterised in that said dielectric barrier is radially extended at said open end.

One embodiment of the parallel device comprises a central flat or specially formed metal electrode and 2 outer metal electrodes, said electrodes being substantially parallel, i.e. at a constant (±1 mm) distance and defining a plasma discharge lumen, said parallel device having an open (proximal) end and a closed (distal) end, said plasma discharge lumen being open to the atmosphere at said open end and comprising a gas flow feed opening at said closed end, a dielectric material interposed between said central metal electrode and said outer metal electrodes and is characterised in that said dielectric barrier is outwardly extended at said open end. According to a specific embodiment, the outer electrodes are connected at the sides to form one electrode which is coaxial with the central electrode. This embodiment and the tubular embodiment are therefore two variations of the cylindrical device with one inner and one outer electrode.

The present invention concerns thus a plasma jet apparatus for performing plasma processing of an article. A cylindrical 2-electrode configuration and a parallel 3-electrode configuration are described. The cylindrical plasma jet device comprises:

- An elongated central electrode,
- An elongated cylindrical outer electrode surrounding said central electrode and being coaxial with said central electrode,
- An electrical insulator coaxially disposed between said outer electrode and said central electrode, wherein a discharge lumen having a distal end and a proximal end is defined between said central electrode and said electrical insulator,
- A supply opening disposed at said distal end of said discharge lumen for supplying a plasma producing gas to said discharge lumen
- A power source for providing a voltage between said central electrode and said outer electrode wherein said electrical insulator extends in a radially placed ring at said proximal end beyond the outer surface of said outer electrode. The electrodes can be tubular and coaxial with a circular cross-section or the central electrode may be a flat, plate-shaped electrode, while the outer electrode has a front and a back side which are substantially parallel to the central electrode. In stead of a flat electrode, the parallel device may have a central electrode with—at the proximal end—a round extension along the length of the electrode, while the outer electrode's front and back faces remain parallel to said central electrode.

According to a preferred embodiment, a supply canal is present through the central electrode for introducing reactive chemical compounds immediately into the plasma afterglow at the proximal end.

The 3-electrode parallel plasma jet device according to the invention comprises:

- A central electrode, for example a flat, plate-shaped electrode,
- 2 outer electrodes at both sides of said central electrode and being substantially parallel to said central electrode,
- 2 electrical insulators disposed substantially parallel between said outer electrodes and said central electrode wherein a discharge lumen having a distal end and a proximal end is defined between said central electrode and said electrical insulators,
- a supply opening disposed at the distal end of said discharge lumen, for supplying a plasma producing gas to said discharge lumen,
- preferably, a supply canal through the central electrode for introducing reactive compounds immediately into the plasma afterglow at the proximal end,
- a power source for providing a voltage between the central and the outer electrodes wherein said electrical insulators extend outwardly at the proximal end beyond the outer surface of the outer electrode In the plasma jet apparatus according to the present invention the electrical insulator preferably further extends towards the distal end at the outer surface of the outer electrode. Advantageously, the distance between an outer surface of the central electrode and the inner surface of the electrical insulator lies between 0.1 and 10 mm. The power source is preferably arranged to provide an AC or Pulse DC voltage between 1 and 10 kV for the tubular configuration and between 1 and 100 kV for the parallel configuration.

Another aspect of the present invention concerns a method for producing a plasma flow, comprising the steps of:

- Providing a plasma jet apparatus according to the present invention,
- Providing a plasma gas flow through the supply opening,
- Providing a reactive chemical compound (e.g. monomer) flow through the supply opening and/or through the central electrode introducing the reactive chemical compound in the plasma discharge at the open end of the plasma), and
- Providing a voltage between 1 and 100 kV between the central electrode and the outer electrode.

SHORT DESCRIPTION OF THE DRAWINGS

DETAILED DESCRIPTION OF THE INVENTION

Figure 1:
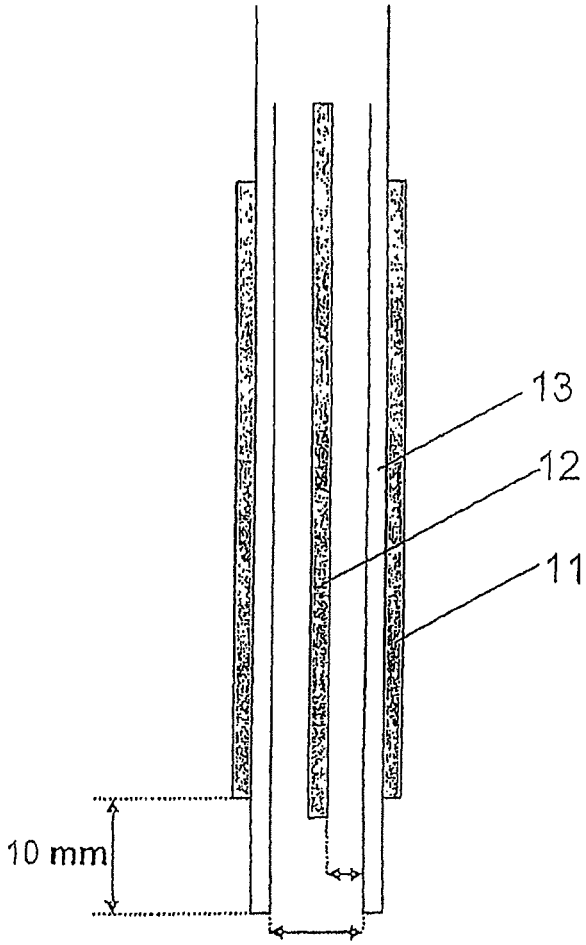
Fig. 1 PRIOR ART
FIG. 1 represents a prior art plasma jet design.

State-of-the-art plasma jets, such as depicted in FIG. 1 usually comprise an outer electrode 11 and inner electrode 12, and a dielectric material 13 interposed there between.

Figure 2:
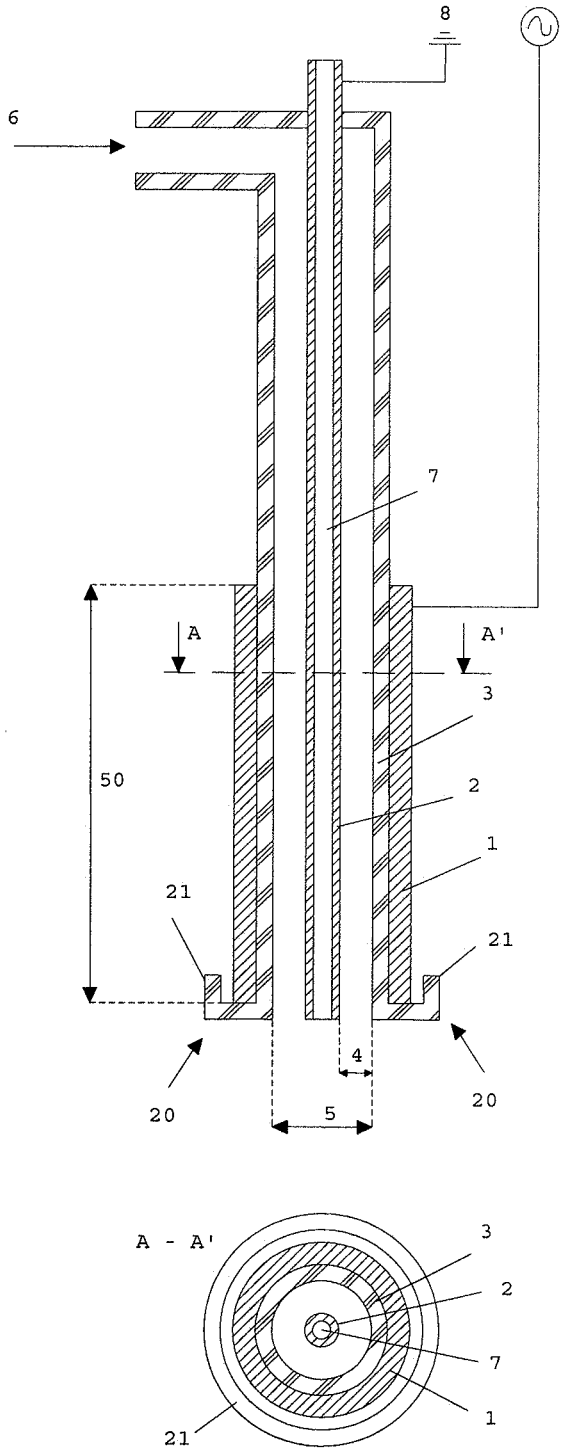
FIG. 2 represents a schematic overview of the plasma jet device according to the present invention.

The tubular embodiment of the present invention can be seen in FIG. 2 and concerns an atmospheric-pressure plasma jet with 2 coaxial, cylindrical electrodes (1, 2) and with one specifically formed electrical insulator in the form of a dielectric material 3. The dielectric barrier is extended at the proximal end of the plasma jet, preferably in the form of a U-shape extension 20. A plasma jet operates at temperatures between 30° C. and 600° C. and can be used for plasma cleaning, surface modification and surface coating. The U-shape dielectric material has major advantages for all these applications. A ring, so just a radial extension for the tubular configuration is also a preferable embodiment (without the return leg 21 of the 'U'). At the distal end of the device, is the supply opening 6, to supply plasma gas to the lumen defined between the central electrode and the dielectric material 3. Preferably, the central electrode 2 is connected to ground 8, while the outer electrode is connected to a voltage source 9. Electrode 1 connected to the ground and electrode 2 connected to a voltage source is also a possible embodiment. The embodiment where both electrodes are connected to a voltage source is also included in this invention. A supply canal 7 through the central electrode 2 can be present for introducing reactive compounds immediately into the plasma afterflow at the open end. The distance 4 between an outer surface of the central electrode and the inner surface of the electrical insulator lies between 0.1 and 10 mm. The distance 5 is the diameter of the homogenous plasma zone. The distance 50 is the height of said homogenous plasma zone, corresponding to the height of the external electrode 1.

The central electrode 2 and the outer electrode 1 can be cylindrical with a circular cross-section, i.e. tubular. Alternatively, the central electrode may be a flat electrode 2, while the outer electrode 1 comprises a front and backside 70, 71 (see FIG. 5A), connected at the sides 72 to form one cylindrical outer electrode 1. The insulator 3 then also comprises front and backsides 73,74 parallel to the central electrode, and connected 75 at the sides to form one cylindrical insulator 3.

Figure 3:
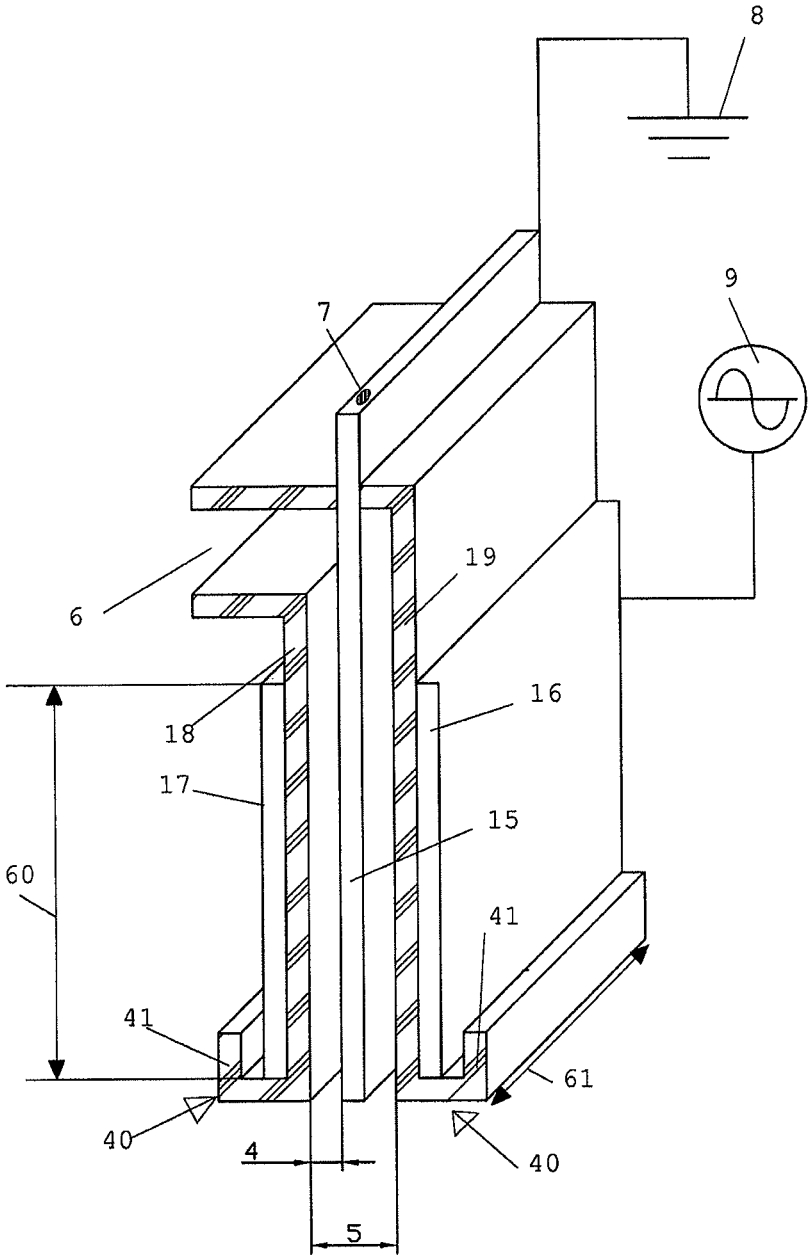
FIG. 3 represents a schematic overview of the parallel plasma jet device according to the present invention.
Figure 5:
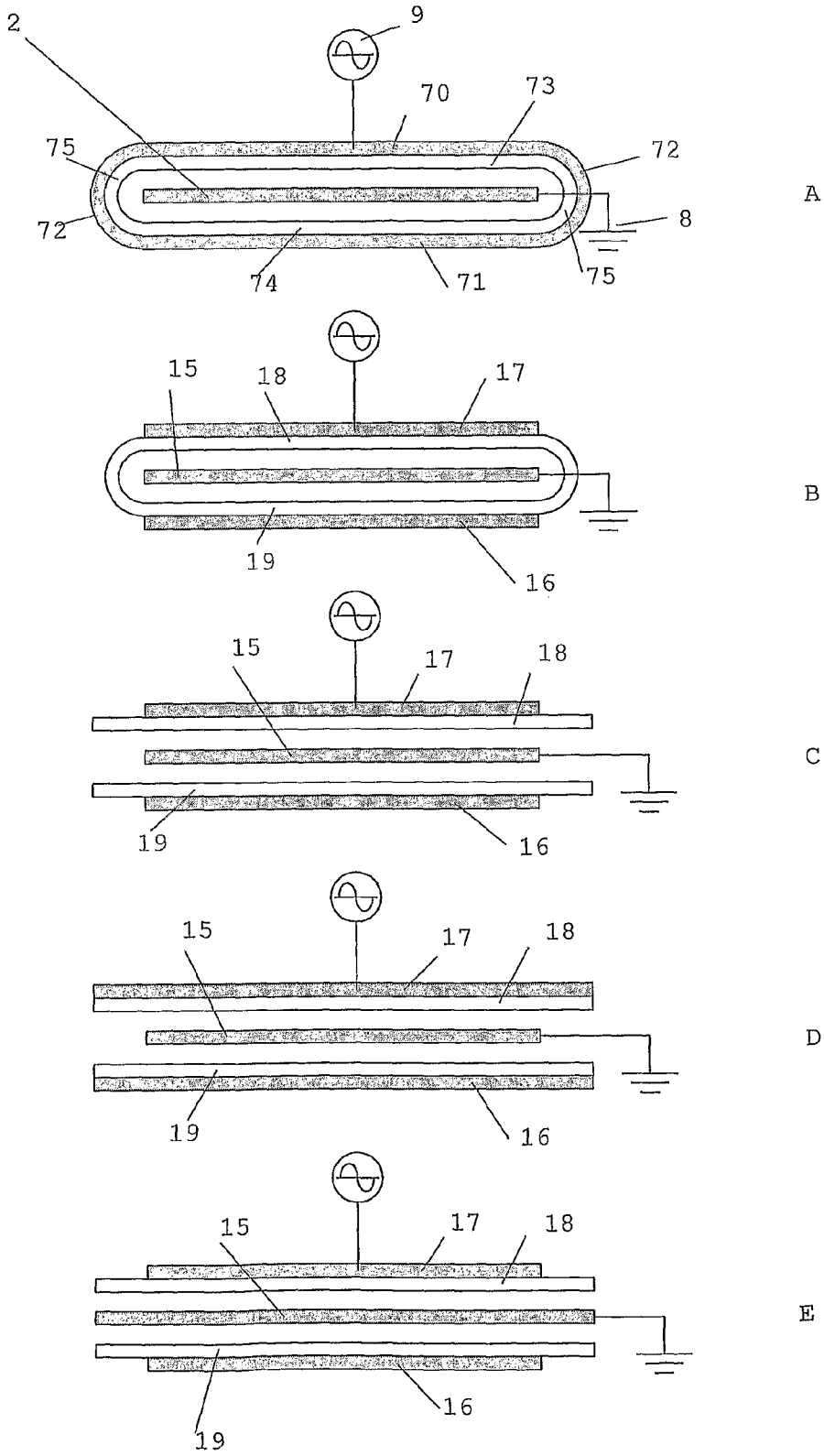
FIG. 5 represents a number of possible cross-sections of parallel plasma jet devices according to the invention.

FIG. 3 shows the plasma jet device according to the invention, equipped with 3 parallel electrodes. The device comprises a central electrode 15, and two parallel electrodes 16, 17 on either side of the central electrode. The figure shows a cut-through view of the device. The actual device is of course closed on the sides. Possible cross-sections are shown in FIG. 5B to 5D. The devices shown in FIG. 5B to 5D are closed at the sides by suitable insulating materials (not shown). The parallel device of FIG. 3 has two dielectric portions 18, 19 which are substantially parallel to the electrodes. At the distal end of the device, the supply opening 6 is present to supply a plasma producing gas to the discharge lumen defined between the central electrode and the insulators. A supply canal 7 through the central electrode 15 can be present for introducing reactive compounds immediately into the plasma afterflow at the open end. The central electrode 15 is connected to ground 8, while the outer electrodes 16,17 are connected to a voltage source 9. The embodiment where the outer electrodes 16, 17 are connected to ground and the central electrode 15 is connected to a voltage source is also included in this invention. Also, the embodiment where both the central electrode 15 as the outer electrodes 16, 17 are connected to a voltage source are included in this invention. At the proximal end of the device, the dielectric portions are produced with an outward extension 40, preferably in the shape of a U, or with a flat outward extension, so without the returning leg 41 of the 'U'. The distance 4 between an outer surface of the central electrode and the inner surface of the electrical insulator lies between 0.1 and 10 mm. The distance 5 is the width of the homogenous plasma zone. The distance 60 is the height of said homogenous plasma zone, corresponding to the height of the external electrodes. The distance 61 is the length of the plasma zone, corresponding to the length (depth) of the device.

Figure 4:
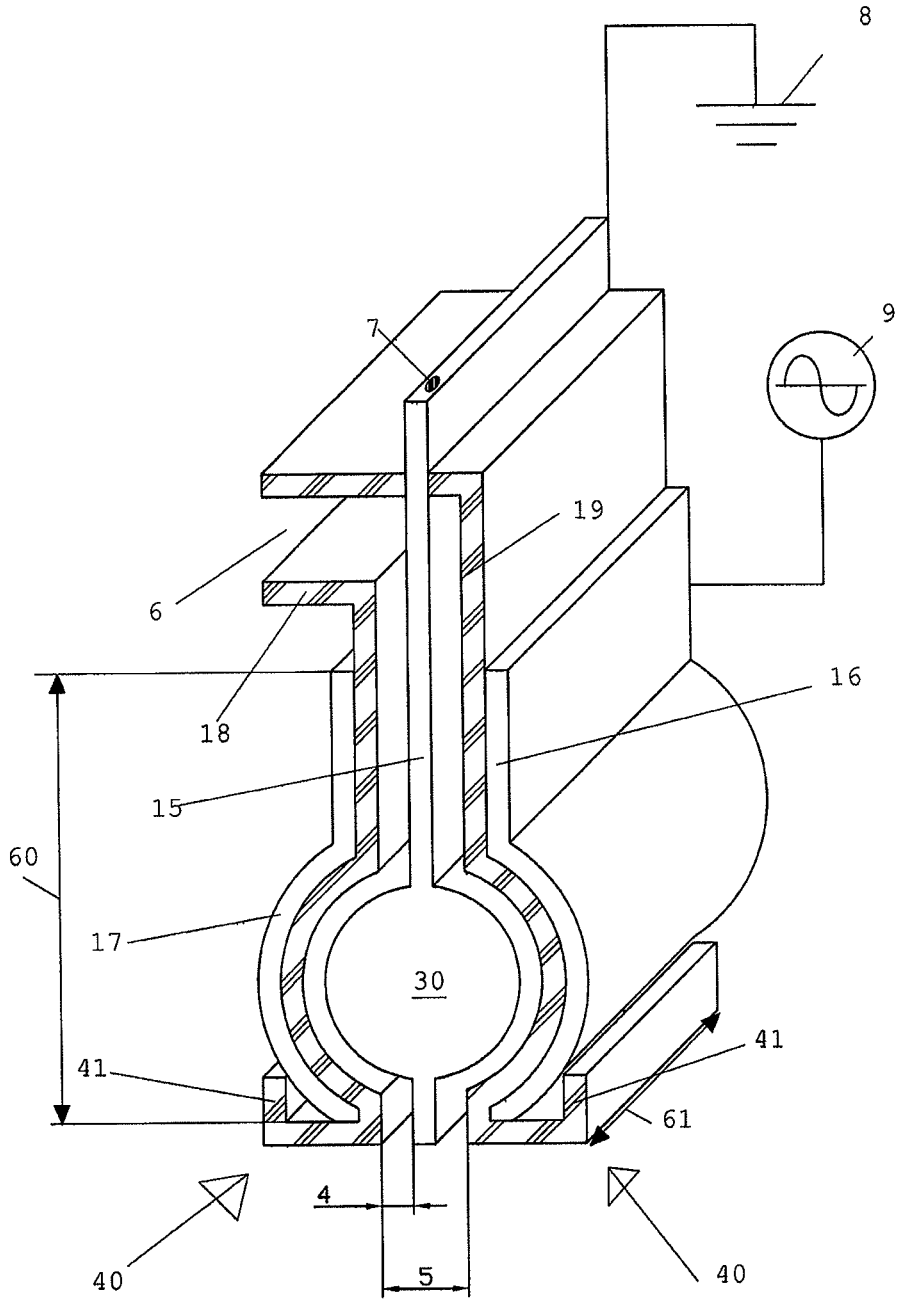
FIG. 4 represents a schematic overview of a special configuration of the embodiment with parallel electrodes.

FIG. 4 shows a possible special configuration of the parallel plasma jet device according to the invention. In this configuration, there is a round extension 30 along the entire length of the central metal electrode 15 at the said open end of the plasma jet. As shown in FIG. 4 both the specifically formed dielectric material (18,19) and the outer metal electrodes (16,17) have a special form in order to guarantee a constant (±1 mm) distance between the outer surface of the central electrode and the inner surface of the electrical insulator. Reference 60 shows the height of the plasma jet, 5 the broadness of the homogenous effective plasma afterglow and 61 the length of the plasma zone in between the parallel electrodes. Because of the round extension 30, the concentration of the afterglow and thus the plasma density in the afterglow are increased.

In general, the following operating characteristics can be used when using the plasma jet according to the present invention:

- Electric power for the tubular device with an electrode height 50 of 10 cm (from here called tubular device): 20-750 Watt;
- electric power for the parallel device (including parallel device with one outer electrode) with an electrode height (50,60) of 10 cm and an electrode length (61) of 10 cm (from here called parallel device): 100-5000 Watt. Applied power is dependent upon application.
- Electric voltage (8): 1-100 kV
- Plasma gas flow (6): 1-400 l/min for the tubular device, 10-4000 l/min for the parallel device.
- Temperature preheated plasma gas: 20-400° C. (This means the plasma gas can be preheated up to 400° C. before being inserted in the plasma jet).

Plasma gases: $N_2$, Air, He, Ar, $CO_2$+mixture of these gases with $H_2$, $O_2$, $SF_6$, $CF_4$, saturated and unsaturated hydrocarbon gases, fluorinated hydrocarbon gases.

Monomer flow: 1-2000 g/min (through canal 7 in the central electrode immediately into plasma afterglow).

Feed gas flow: 0.1-30 l/min (through canal 7 in the central electrode immediately into plasma afterglow).

Inner gap distance (4): 0.1-10 mm (dependent upon plasma gas and application).

Diameter (for tubular device) or broadness (5) (for parallel device) of the homogeneous plasma zone: 6-80 mm.

Length of effective plasma afterglow: 5-100 mm. (dependent upon application).

When a high voltage AC or pulsed DC power is put on one of the electrodes, a dielectric barrier discharge takes place in between the dielectricum and the inner electrode. The active species from the plasma are blown out of the plasma jet by the plasma gas flow. This afterglow is directed against a sample and this way 3-D objects can be plasma treated. In case a pulsed DC power is used, the frequency is preferably comprised between 1 and 200 kHz, and advantageously between 50 and 100 kHz The advantages of the radially or outwardly extending dielectricum from the plasma jet apparatus according to the present invention can be summarised with the following 3 concepts: distance to the plasma source, width of activation and consumption of plasma gases.

Distance to the Plasma Source

It should be noted that radicals, and particularly ions, in the plasma discharge are extremely short lived, and can almost not be transported outside the discharge region. Metastable species produced inside the plasma, on the other hand, have longer lifetimes at atmospheric pressure, typically in the order of hundreds of milliseconds. This longer lifetime allows them to be carried out of the plasma volume with the plasma gas flow. Obviously the most reactive metastable species will be lost first. The closer to the plasma source the more reactive the plasma afterglow. With the novel plasma jet apparatus according to the present invention, samples can be brought up to 2 mm from the actual plasma source. Experiments have shown that stable activation of certain polymers can only be realised when using the described plasma jet configuration with the radially or outwardly extending dielectricum.

Examples

Plasma Activation of Rubber:

Rubber is impossible to activate sufficiently with the classical concept: the distance rubber/plasma source seems to be too large. The most reactive and in this case needed species of the plasma are lost before they hit the rubber sample.

When using a U-shaped dielectricum such as in FIG. 2, more reactive plasma afterglow is obtained Parameters:

Power: 400 Watt
Frequency: 70 kHz
Plasma gas: 65 l air/min
Precursor: none
Temperature plasma after glow: 65° C.
distance rubber/plasma source: 4 mm
surface energy before plasma activation: ±20 dynes.
surface energy after plasma activation: >75 dynes.
surface energy 1 week after plasma activation: 62 dynes.

Plasma Activation of PVC:

PVC is thermal sensitive. The activation performed with the classical concept is not stable in time. After a few hours, activation was completely lost.

When using a U-shaped dielectricum, more reactive plasma afterglow is obtained.

Power: 300 Watt
Frequency: 32 kHz
Plasma gas: 60 l $N_2$/min.
precursor: none.
Temperature plasma afterglow: 60° C.
distance PVC/plasma source: 5-7 mm.
surface energy before plasma activation: 45 dynes.
surface energy after plasma activation: >75 dynes.
surface energy 1 week after plasma activation: 64 dynes.
surface energy 1 month after plasma activation: 56 dynes.
surface energy 4 months after plasma activation: 54 dynes.

Width of Activation

If flat samples are brought close to a plasma afterglow, the active species of the plasma afterglow are spread out over a certain region in between the plasma jet and the samples. This means that the activated spot can be much broader than the diameter of the plasma jet. The closer the samples are brought to the actual plasma source, the broader the activated spot will be. Experiments have confirmed that with the plasma jet according to the invention (with U-shaped dielectricum) this activated spot for the same plasma conditions is much broader than with the classical concept.

Examples

Plasma Activation of Polyethylene:

Increasing the broadness of the activated spot would decrease the overall working costs of a (multi-) plasma jet. When using a plasma jet according to the present invention, more reactive plasma afterglow is obtained and active species are spread out over a broader region.

Power: 200 Watt
Frequency: 50 kHz
Plasma gas: 50 l $N_2$/min
Precursor: none
Temperature plasma after glow: 65° C.
diameter plasma jet: 15 mm
surface energy before plasma activation: 32 dynes.
surface energy after plasma activation: 62 dynes.

| Distance sample/plasma source (mm): | Broadness of homogenous activated spot (mm) (62 dynes): |
|---|---|
| 2.5 | 45 |
| 4 | 41 |
| 6 | 25 |
| 8 | 22 |
| 10 | 22 |
| 12.5 | 22 |
| 15 | 22 |
| 20 | 18 |
| 30 | 7 |
| 35 | 3 |

With the classical concept the broadness of homogenous activated spot was maximum 32 mm at 1.5 mm distance sample/plasma jet.

Plasma Activation of Polypropylene:

Increasing the broadness of the activated spot would decrease the overall working costs of a (multi-) plasma jet. When using a plasma jet according to the present invention, more reactive plasma afterglow is obtained and active species are spread out over a broader region.

Power: 200 Watt
Frequency: 50 kHz
Plasma gas: 50 l air/min
Precursor: none
Temperature plasma after glow: 65° C.
diameter plasma jet: 15 mm
surface energy before plasma activation: 36 dynes.
surface energy after plasma activation: 70 dynes.

| Distance sample/plasma source (mm): | Broadness of homogenous activated spot (mm) (70 dynes): |
|---|---|
| 2.5 | 48 |
| 4 | 45 |
| 6 | 26 |
| 8 | 22 |
| 10 | 22 |
| 12.5 | 22 |
| 15 | 22 |
| 20 | 20 |
| 30 | 12 |
| 35 | 4 |

With the classical concept the broadness of homogenous activated spot was maximum 33 mm at 1.5 mm distance sample/plasma jet.

Consumption of Plasma Gases/Plasma Power

As a consequence of the fact that the samples can be brought closer to the actual plasma zone, less reactive species are lost in the afterglow. So compared to the classical plasma jet, the same effect can be obtained with a lower consumption of gas and/or power. This last advantage can be seen as an indirect consequence of the two former advantages.

It has been shown experimentally that one needs less gasses and/or power for the same plasma activation effect. Such experiments can be performed by the skilled person.

The invention claimed is:

1. A plasma jet apparatus for performing plasma processing of an article, comprising:

a central electrode shaped as a plate having a height extending in a first direction, and a length extending perpendicularly to the height, one outer electrode or a pair of outer electrodes shaped to extend at both sides of the central electrode and being substantially parallel to the central electrode, each of said outer electrodes having an inner surface facing the central electrode, and an outer surface opposite the inner surface, a dielectric material layer disposed at the inner surface of each of the outer electrodes and substantially parallel to the central electrode, wherein the dielectric material is spaced apart from the central electrode to create a plasma discharge lumen between the dielectric material layer and the central electrode extending in the first direction between a distal end and a proximal end;

a supply opening disposed at the distal end of the discharge lumen, for supplying a plasma producing gas to the discharge lumen, wherein the discharge lumen is open to the atmosphere in the first direction at the proximal end, a power source for providing a voltage between the central and the outer electrodes, wherein at the proximal end the apparatus comprises at each of both sides of the central electrode an extension made of a dielectric material and a return leg made of a dielectric material;

wherein the extension is arranged beyond the outer electrode when viewed along the first direction, wherein the extension extends outwardly between the dielectric material layer and the return leg along a second direction substantially perpendicular to the first direction;

wherein the return leg is arranged beyond the outer surface of the outer electrode when viewed in the second direction, wherein the return leg extends along the first direction from the extension towards the distal end, and wherein the return leg is spaced apart from the outer electrode.

2. The apparatus according to claim 1, further comprising a supply canal through the central electrode for introducing reactive compounds immediately into plasma afterglow at the proximal end.

3. The apparatus according to claim 1, wherein the central electrode is a flat electrode.

4. The plasma jet apparatus of claim 1, wherein the extension has a width between 6 mm and 80 mm in the second direction.

5. The plasma jet apparatus of claim 1, wherein the central electrode extends along the first direction as far as the dielectric material layers.

6. The plasma jet apparatus of claim 1, wherein the central electrode is grounded and the outer electrode is configured to be coupled to the power source.

7. A method of plasma processing of an article, comprising the steps of:

providing a plasma jet apparatus, comprising: a central electrode shaped as a plate having a height extending in a first direction, and a length extending perpendicularly to the height, one or more outer electrodes shaped to extend at both sides of the central electrode and being substantially parallel to the central electrode, each of the outer electrodes having an inner surface facing the central electrode, and an outer surface opposite the inner surface, a dielectric material disposed at the inner surface of one or more outer electrodes and substantially parallel to the central electrode, wherein the dielectric material layer is spaced apart from the central electrode to create a discharge lumen between the dielectric material layer and the central electrode extending in the first direction between a distal end and a proximal end, a supply opening disposed at the distal end of the discharge lumen, for supplying a plasma producing gas to the discharge lumen, the discharge lumen being open to the atmosphere in the first direction at the proximal end, a power source for providing a voltage between the central and the outer electrodes, wherein at the proximal end and at each of both sides of the central electrode the apparatus comprises an extension made of a dielectric material and a return leg made of a dielectric material, wherein the extension is arranged beyond the outer electrode when viewed along the first direction, wherein the extension extends outwardly along a second direction substantially perpendicular to the first direction until the return leg, wherein the return leg extends along the first direction, from the extension towards the distal end and is spaced apart from the outer electrode;

providing a plasma gas flow through the supply opening;

providing the article at the proximal end of the discharge lumen so that the outwardly extending part of the insulators faces the article at a distance;

providing a reactive chemical compound flow through the supply opening and/or through the central electrode introducing the reactive chemical compound in a plasma discharge at the proximal end; and providing a voltage between 1 and 100 kV between the central electrode and the outer electrode and generating the plasma discharge in the discharge lumen, wherein the plasma discharge jets from the discharge lumen at the proximal end in the first direction toward the article and a plasma afterglow spreads out in the second direction, between the outwardly extending part of the insulators and the article, increasing an activated spot on the article.

* * * * *